United States Patent [19]

Alexander, III

[11] Patent Number: 4,492,257

[45] **Date of Patent: * Jan. 8, 1985**

[54] ON LOOM CLOTH TAKEUP WITH OSCILLATING GUIDE ROLL

[76] Inventor: William J. Alexander, III, 41 W. Golden Strip Dr., Mauldin, S.C. 29662

[ * ] Notice: The portion of the term of this patent subsequent to Jun. 28, 2000 has been disclaimed.

[21] Appl. No.: 454,703

[22] Filed: Dec. 30, 1982

[51] Int. Cl.[3] ..... D03D 49/20

[52] U.S. Cl. ..... 139/304; 242/66

[58] Field of Search ..... 139/304, 305, 306, 307, 139/308, 309, 310; 242/66, 76, 158.1, 67.1 R, 67.3 R

[56] References Cited

U.S. PATENT DOCUMENTS

| | | | |
|---|---|---|---|
| 2,903,195 | 9/1959 | Penland et al. | 242/67.2 |
| 4,252,154 | 2/1981 | Alexander | 139/304 |
| 4,390,139 | 6/1983 | Alexander | 139/304 |

*Primary Examiner*—Henry S. Jaudon

*Attorney, Agent, or Firm*—Bailey & Hardaway

[57] ABSTRACT

A loom is illustrated having an oscillating guide roll receiving cloth made on the loom for guiding same to the center wound takeup. Means are provided for oscillating the guide roll which includes a drive roll also driven by the cloth for driving mounting means for the guide roll at a speed differential in order to produce an oscillatory motion determined by the movement of the cloth.

5 Claims, 3 Drawing Figures

ON LOOM CLOTH TAKEUP WITH OSCILLATING GUIDE ROLL

BACKGROUND OF THE INVENTION

This is an improvement upon the oscillating guide roll illustrated in U.S. Pat. No. 4,252,154, and the oscillating roll illustrated in patent application Ser. No. 290,612 filed Aug. 6, 1982 now U.S. Pat. No. 4,390,139. The patent illustrates a guide roll wherein oscillations are imparted by means of mechanical linkage, whereas the application discloses an oscillating guide roll wherein mounting means for the oscillating roll are driven at a predetermined speed in relation to takeup or cloth speed to drive the oscillating roll through a cam turning at a differential speed to the mounting means responsive to the cloth moving thereover. The disclosures of the patent and the patent application are incorporated herein by reference.

It is an important object of this invention to provide an oscillating guide roll, particularly for use in on-loom takeups which manufacture cloth having a tucked or otherwise thickened selvage such as the Sulzer loom.

SUMMARY OF THE INVENTION

It has been found that an improved oscillating guide roll assembly may be provided in combination with center wound takeups carried by looms such as the Sulzer loom wherein a thickened selvage is produced in order to prevent stacking of the thickened edges with resultant sloughing of the resulting soft rolls. By moving the selvage back and forth so as to avoid stacking as the build of the cloth roll takes place these disadvantages are avoided.

It has further been found that a driving means may be provided which, like the guide roll, may be driven by the cloth passing thereon. This drive may be utiized to rotate cam mounting means positioning the guide roll to impart oscillatory motion thereto through a speed differential between the rolls and the cam means.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a loom having a driven cloth takeup roll carried on a shaft A for center winding on the loom. An oscillating guide roll is illustrated at B over which cloth F passes on the way to the takeup roll. Guide means C directs cloth manufactured on the loom rearwardly above the cloth roll. The guide roll B receives the cloth from the guide means. Means D mounts the guide roll for oscillatory movement longitudinallty thereof. Drive means E rotates the mounting means D imparting oscillatory movement to the guide roll throuth cam means interposed between the cam means and the guide roll. The shaft A carries the cloth roll for center winding of the cloth delivered from the guide roll. Thus, the edges of the cloth are moved from side to side during the build of the cloth roll sufficient to avoid alignment of the edges.

Figure 1:
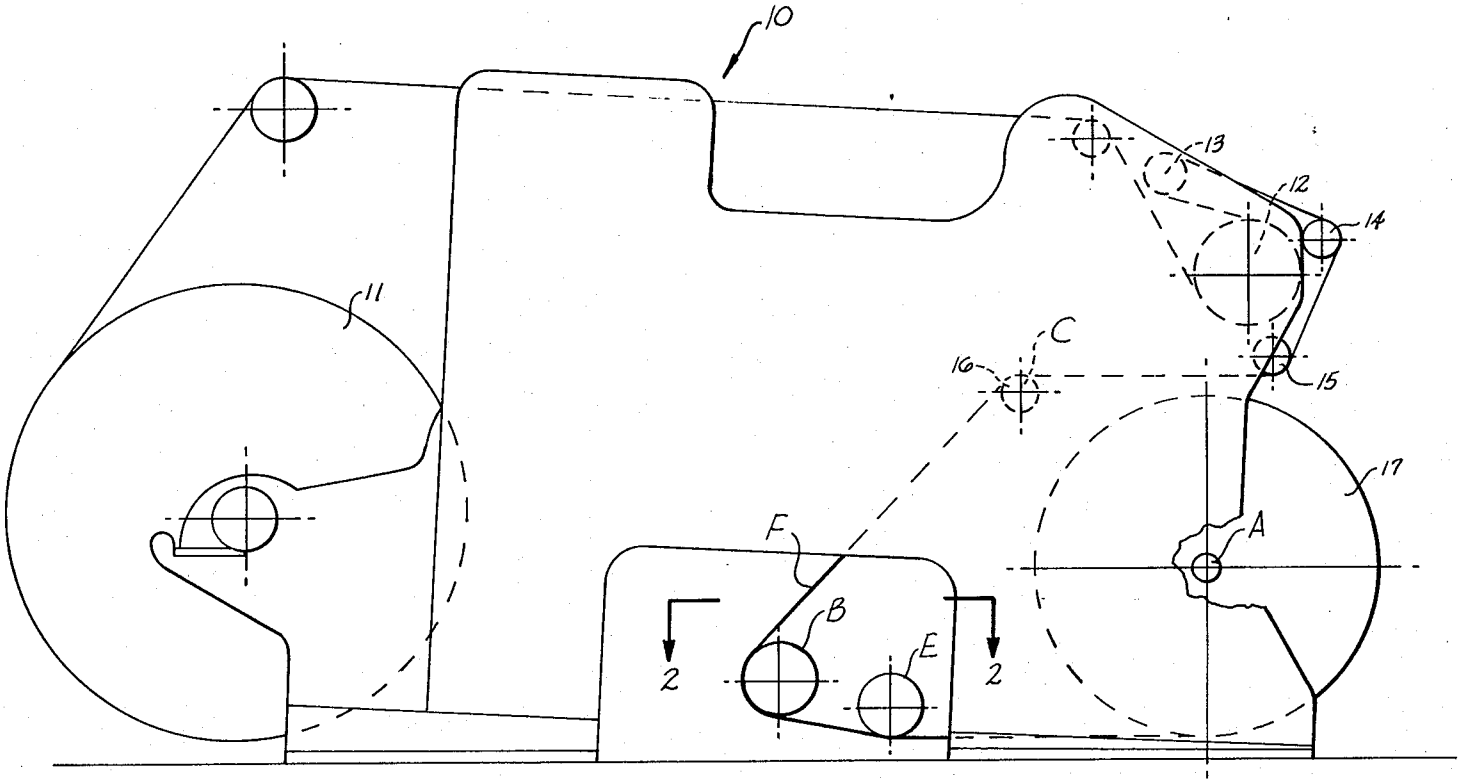
FIG. 1 is a schematic side elevation illustrating the cloth path in respect of a loom equipped with a center wound takeup with oscillating guide roll constructed in accordance with the present invention.

FIG. 1 schematically illustrates a loom broadly designated at 10. The loom has a warp beam 11 for carrying warp yarns to be woven and the resulting fabric fed beneath a guide roll such as the sand roll 12, and thence over guide rolls 13, 14 and 15 which form a part of a guide means C which includes a guide roll 16 for directing cloth manufactured on the loom rearwardly above the cloth roll 17. The cloth roll 17 is carried on a shaft A for center winding. The cloth designated at F further follows this path to move thence downwardly over the oscillating guide roll B and under the drive roll or guide means E to the cloth roll 17.

Figure 2:
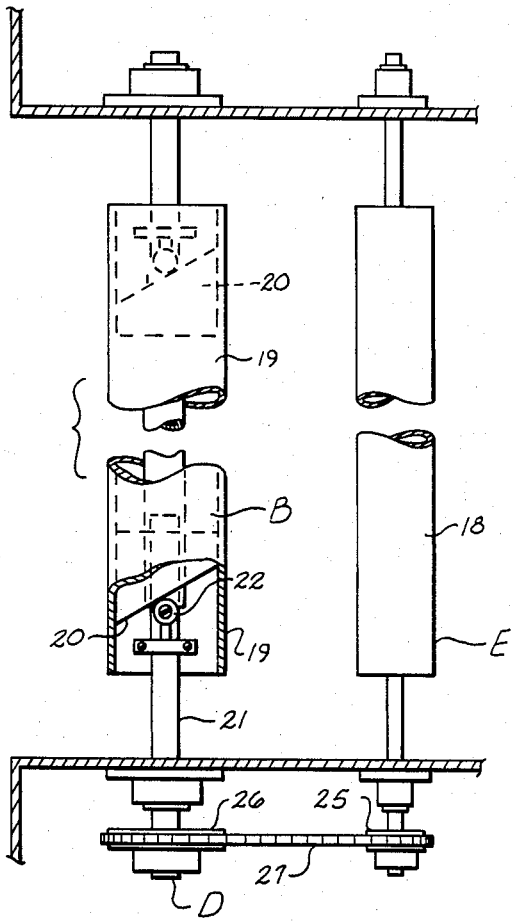
FIG. 2 is a plan view taken on the line 2—2 in FIG. 1 with parts broken away illustrating the cam mechanism for imparting oscillatory movement to the guide roll through a differential in speed between the guide roll and the cam, both of which are driven by the fabric passing thereover.
Figure 3:
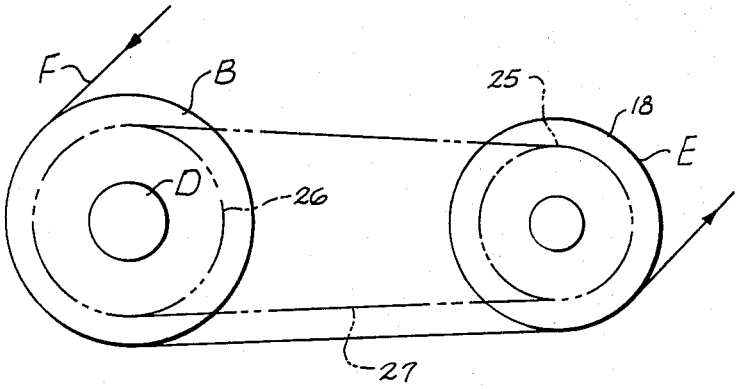
FIG. 3 is a schematic side elevation illustrating the drive relationship between the drive roll and the guide roll.

The guide roll B is illustrated as being driven by cloth F passing thereover and the drive means E includes a drive roll 18 (FIGS. 2 and 3) over which the cloth passes. The guide roll B is rotated by the cloth passing thereover and includes a shell 19 together with a fixed inclined cam 20 at each end therein for inducing oscillation in direction of the arrow logintudinally of the guide roll. The means D for mounting the guide roll 20 includes a shaft 21 which carries a second cam means 22 which is rotated with the shaft 21 at a speed differential to that of the inclined or first cam means 20 which has fixed relation to the shell 19 of the guide roll B. The differential in rotation which may be either plus or minus should be relatively slight in order to impart low frequency oscillations to the cloth through the shell 19 of the guide roll B. The differential in speed may be accounted for by the differential and the size of the drive roll E and the relationship of the sprocket 25 carried thereby to the sprocket 26 carrying the guide roll B. The sprocket 25 drives the sprocket 26 as schematically illustrated in FIG. 3 through a suitable chain 27.

Thus, the first cam means 20 which is carried by the guide roll shell operates in combination with the second cam means which includes the rotatable cam follower 22 rotated responsive to the drive roll 18 of the drive means E in order to impart oscillatory movement to the guide roll through the speed differential plus or minus between the first and second cam means.

The takeup roll may be mounted so as to build to a relatively large size while being driven under a tension control as illustrated in patent application Ser. No. 290,732 filed Aug. 6, 1981, now U.S. Pat. No. 4,422,479 the disclosure of which is incorporated and made a part hereof by reference.

While a preferred embodiment of the invention has been described using specific terms, such description is for illustrative purposes only and it is to be understood that changes and variations may be made without departing from the spirit or scope of the following claims.

What is claimed is:

1. In a loom having a driven cloth takeup roll carried on the loom, an oscillating guide over which cloth passes on the way to said takeup roll comprising:

guide means directing cloth manufactured on the loom rearwardly above the cloth roll;

a guide roll receiving said cloth from said guide means;

means mounting said guide roll for oscillatory movement longitudinally thereof;

drive means imparting oscillatory movement to said guide roll; and means carrying said cloth roll for center winding of the cloth delivered from said guide roll;

whereby the edges of the cloth are moved from side to side during the build of the cloth roll sufficiently to avoid alignment of the edges.

2. The structure set forth in claim 1 wherein said guide roll is driven by cloth passing thereover, and wherein said drive means is driven by a drive roll over which said cloth passes on its way to the takeup roll driving said mounting means at a speed differential to the speed of the guide roll.

3. The structure set forth in claim 2 including first cam means carried by said guide roll, and second cam means driven by said drive roll operating in combination with said first cam means to impart oscillatory movement to said guide roll.

4. In a loom having a driven cloth takeup roll carried on the loom, an oscillating guide over which cloth passes on the way to said takeup roll comprising:

a transverse guide roll receiving cloth manufactured on the loom;

means mounting said guide roll for oscillatory movement longitudinally thereof;

drive means imparting oscillatory movement to said guide roll; and means carrying said cloth roll for center winding of the cloth delivered from said guide roll;

whereby the edges of the cloth are moved from side to side during the build of the cloth roll sufficiently to avoid alignment of the edges.

5. A loom takeup having a driven cloth roll and an oscillating guide over which cloth passes on the way to said takeup roll comprising:

a guide means directing cloth manufactured on the loom to the cloth roll;

a guide roll receiving said cloth from said guide means and being driven thereby;

means mounting said guide roll for oscillatory movement longitudinally thereof;

a drive roll over which said cloth passes on its way to the takeup driving said mounting means at a speed differential to the speed of the guide roll;

cam means carried between said mounting means and said drive roll producing oscillatory movement of the guide roll responsive to a speed differential between said mounting means and said guide roll;

whereby the edges of the cloth are moved from side to side during the build of the cloth roll sufficiently to avoid alignment of the edges.

* * * * *